US011052271B1

(12) United States Patent
Aryee

(10) Patent No.: US 11,052,271 B1
(45) Date of Patent: Jul. 6, 2021

(54) AUTOMATIC FIRE EXTINGUISHER

(71) Applicant: Frederick Aryee, San Diego, CA (US)

(72) Inventor: Frederick Aryee, San Diego, CA (US)

( * ) Notice: Subject to any disclaimer, the term of this patent is extended or adjusted under 35 U.S.C. 154(b) by 167 days.

(21) Appl. No.: 16/444,130

(22) Filed: Jun. 18, 2019

Related U.S. Application Data

(63) Continuation-in-part of application No. 15/936,722, filed on Mar. 27, 2018, now Pat. No. 10,814,152.

(51) Int. Cl.
*A62C 3/08* (2006.01)
*A62C 35/02* (2006.01)
*A62C 35/68* (2006.01)

(52) U.S. Cl.
CPC ..... *A62C 3/08* (2013.01); *A62C 35/023* (2013.01); *A62C 35/68* (2013.01)

(58) Field of Classification Search
CPC ..... A62C 37/48; A62C 35/023; A62C 3/08; A52C 35/68
USPC ..... 169/57
See application file for complete search history.

(56) References Cited

U.S. PATENT DOCUMENTS

| | | | | |
|---|---|---|---|---|
| 2,871,952 | A * | 2/1959 | Doak | A62C 13/003 169/26 |
| 4,592,301 | A * | 6/1986 | Monte | G08B 13/1472 116/162 |
| D307,647 | S | 5/1990 | Yasuo | |
| 5,315,292 | A | 5/1994 | Prior | |
| 5,954,138 | A * | 9/1999 | Gabriel | A62C 37/12 169/20 |
| 6,540,155 | B1 | 4/2003 | Yahav | |
| 7,172,031 | B2 | 2/2007 | Piatti | |
| 7,182,144 | B2 | 2/2007 | Baba | |
| 8,607,888 | B2 | 12/2013 | Nusbaum | |
| 8,973,671 | B2 | 3/2015 | Alsaif | |
| 9,345,914 | B1 | 5/2016 | Haji | |
| 2008/0087446 | A1 * | 4/2008 | Sitabkhan | A62C 37/12 169/57 |

FOREIGN PATENT DOCUMENTS

| | | | |
|---|---|---|---|
| JP | 8-225035 | * | 9/1996 |
| WO | 2008103282 | A | 8/2008 |

* cited by examiner

*Primary Examiner* — Qingzhang Zhou
(74) *Attorney, Agent, or Firm* — Kyle A. Fletcher, Esq.

(57) ABSTRACT

The automatic fire extinguisher is an automated fire retardant dispensing device. The automatic fire extinguisher is a self-contained unit. The automatic fire extinguisher is configured for use in a commercial aircraft. The automatic fire extinguisher is contained within a pillow that is commonly used for the comfort of passengers within the commercial aircraft. The automatic fire extinguisher is a temperature sensitive device. The automatic fire extinguisher dispenses the fire retardant when the temperature of the automatic fire extinguisher reaches a predetermined temperature. In the primary embodiment of the automatic fire extinguisher, when the predetermined temperature is reached, the automatic fire extinguisher releases a fire retardant in the form of a compressed gas into the atmosphere. In a secondary embodiment of the disclosure, the automatic fire extinguisher releases both the fire retardant and water into the atmosphere.

18 Claims, 6 Drawing Sheets

AUTOMATIC FIRE EXTINGUISHER

CROSS REFERENCES TO RELATED APPLICATIONS

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety.

STATEMENT REGARDING FEDERALLY SPONSORED RESEARCH

Not Applicable

REFERENCE TO APPENDIX

Not Applicable

BACKGROUND OF THE INVENTION

The present invention relates to the field of life-saving including firefighting equipment, more specifically, a fire extinguisher with a single permanently pressurized chamber.

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety. Within this disclosure, the non-provisional application U.S. Ser. No. 15/936,722 will also be referred to as the prior disclosure.

The present disclosure will only reference the elements of the non-provisional application U.S. Ser. No. 15/936,722 that are relevant to the innovations disclosed within this application. This is done for purposes of simplicity and clarity of exposition. The applicant notes that this disclosure incorporates non-provisional application U.S. Ser. No. 15/936,722 in its entirety into this application. The fact that any specific innovation selected from the one or more innovations disclosed within U.S. Ser. No. 15/936,722 is not addressed in this application should not be interpreted as an indication of defect in the above-referenced patent.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure discloses an automated fire retardant dispensing device. The prior disclosure is a self-contained device with a single moving part. The prior disclosure is a temperature sensitive device that releases a fire retardant in the form of a compressed gas when a predetermined ambient temperature has been reached. The prior disclosure comprises a compressed retardant gas, a high-pressure gas tank, and a release valve. The release valve releases the compressed retardant gas from the high-pressure gas tank into the atmosphere. The prior disclosure identifies the compressed retardant gas as diatomic nitrogen.

The release valve is a normally open spring loaded valve. The release valve is held in a closed position using a thermal epoxy detent. The thermal epoxy detent holds the spring in a deformed position such that the release valve is locked in a closed position. When the predetermined ambient temperature has been reached, the thermal epoxy detent melts thereby opening the release valve in the open position and releasing the compressed retardant gas into the atmosphere.

SUMMARY OF INVENTION

The automatic fire extinguisher is an automated fire retardant dispensing device. The automatic fire extinguisher is a self-contained unit. The automatic fire extinguisher is configured for use in a commercial aircraft. The automatic fire extinguisher is contained within a pillow that is commonly used for the comfort of passengers within the commercial aircraft. The automatic fire extinguisher is a temperature sensitive device. The automatic fire extinguisher dispenses the fire retardant when the temperature of the automatic fire extinguisher reaches a predetermined temperature. In the primary embodiment of the automatic fire extinguisher, when the predetermined temperature is reached, the automatic fire extinguisher releases a fire retardant in the form of a compressed gas into the atmosphere. In a secondary embodiment of the disclosure, the automatic fire extinguisher releases both the fire retardant and water into the atmosphere.

The primary embodiment is formed with one moving part and no mechanical linkages. The secondary embodiment is formed with two moving parts and no mechanical linkages. The primary embodiment comprises a compressed retardant gas, a high-pressure gas tank, and a release valve, one or more nozzles, a whistle, and the pillow. The secondary embodiment comprises the components of the primary embodiment and further comprises a chamber, a plug, water, and a check valve.

These together with additional objects, features and advantages of the automatic fire extinguisher will be readily apparent to those of ordinary skill in the art upon reading the following detailed description of the presently preferred, but nonetheless illustrative, embodiments when taken in conjunction with the accompanying drawings.

In this respect, before explaining the current embodiments of the automatic fire extinguisher in detail, it is to be understood that the automatic fire extinguisher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automatic fire extinguisher.

It is therefore important that the claims be regarded as including such equivalent construction insofar as they do not depart from the spirit and scope of the automatic fire extinguisher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
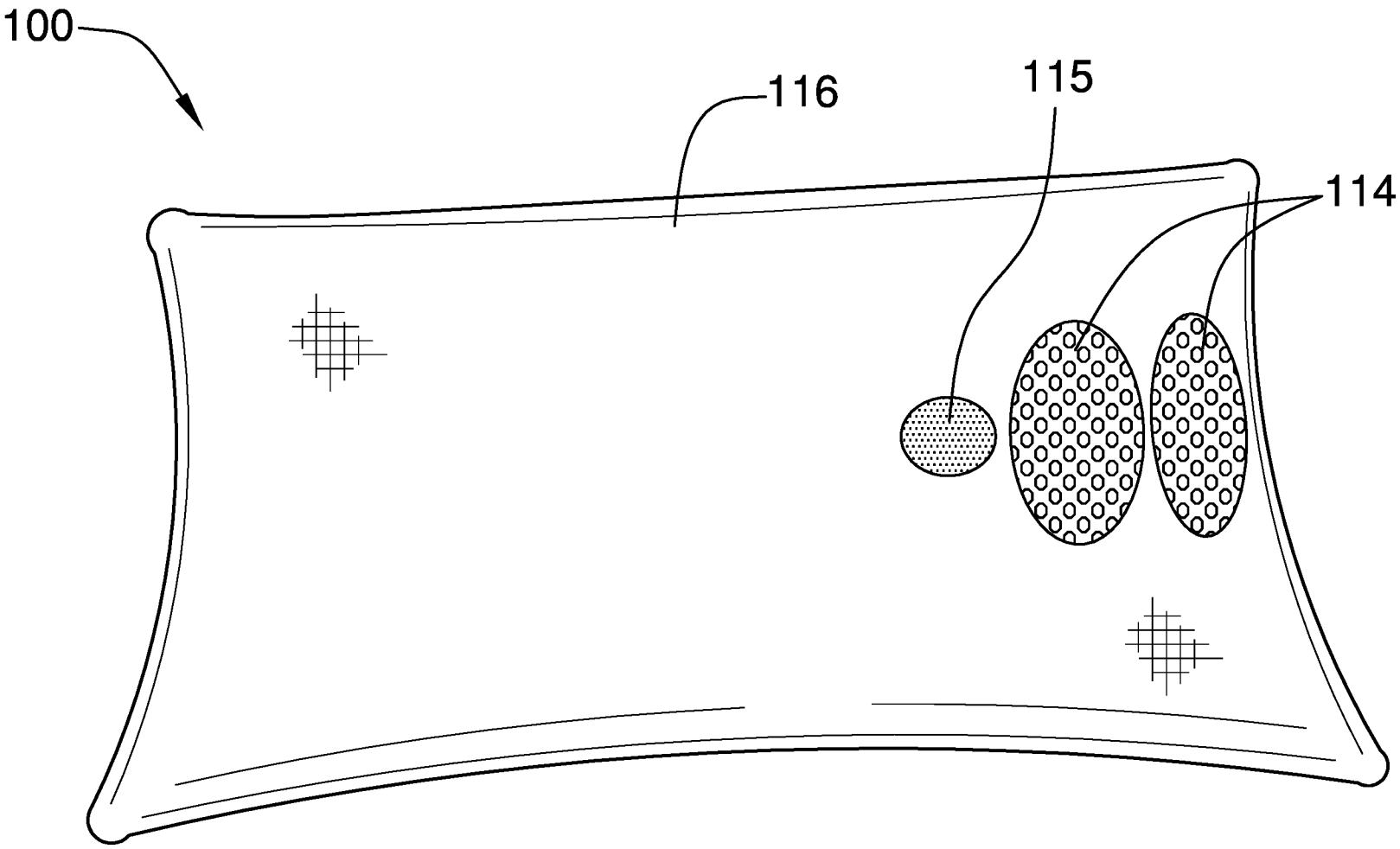
FIG. 1 is a perspective view of an embodiment of the disclosure.
Figure 2:
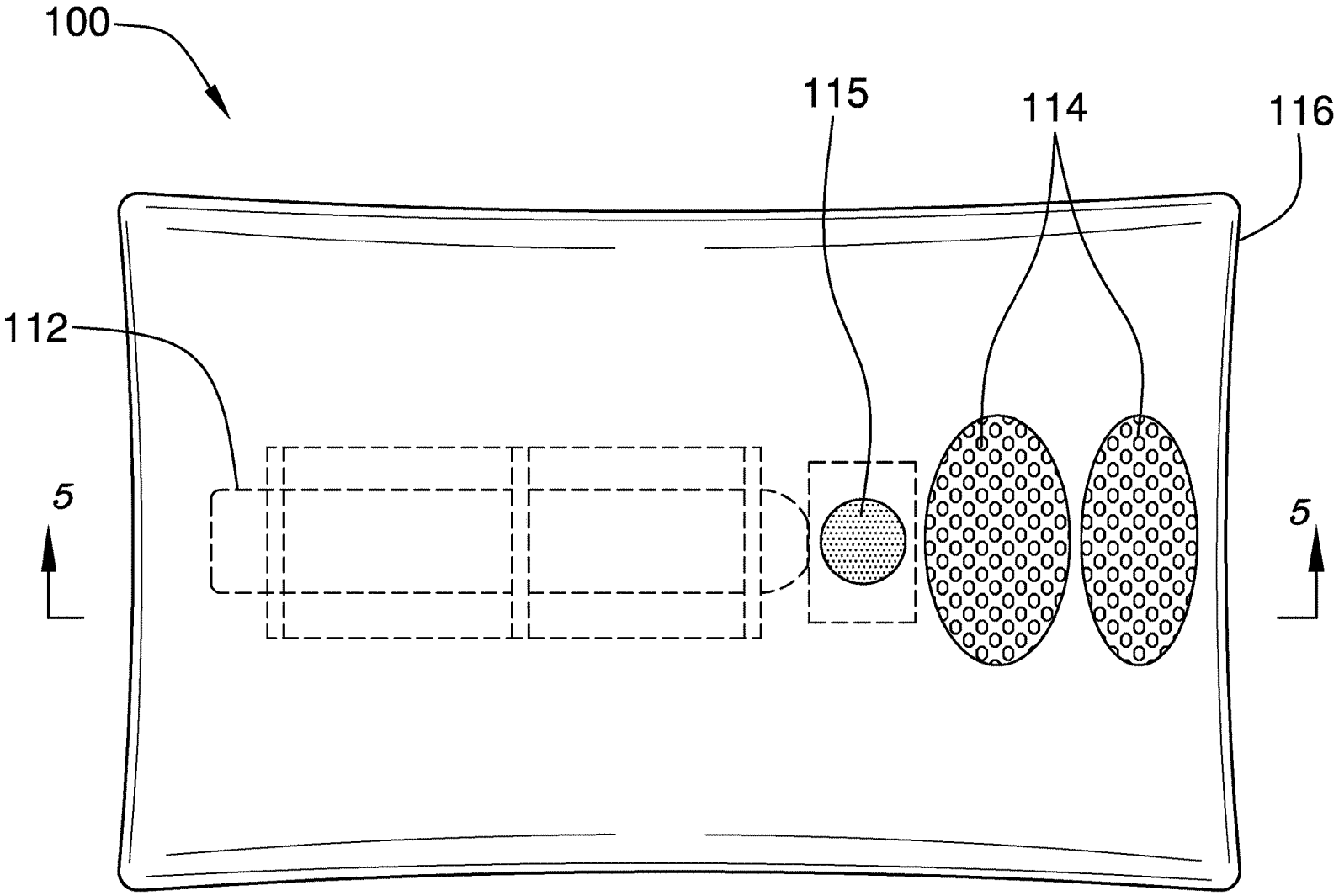
FIG. 2 is a top view of an embodiment of the disclosure.
Figure 3:
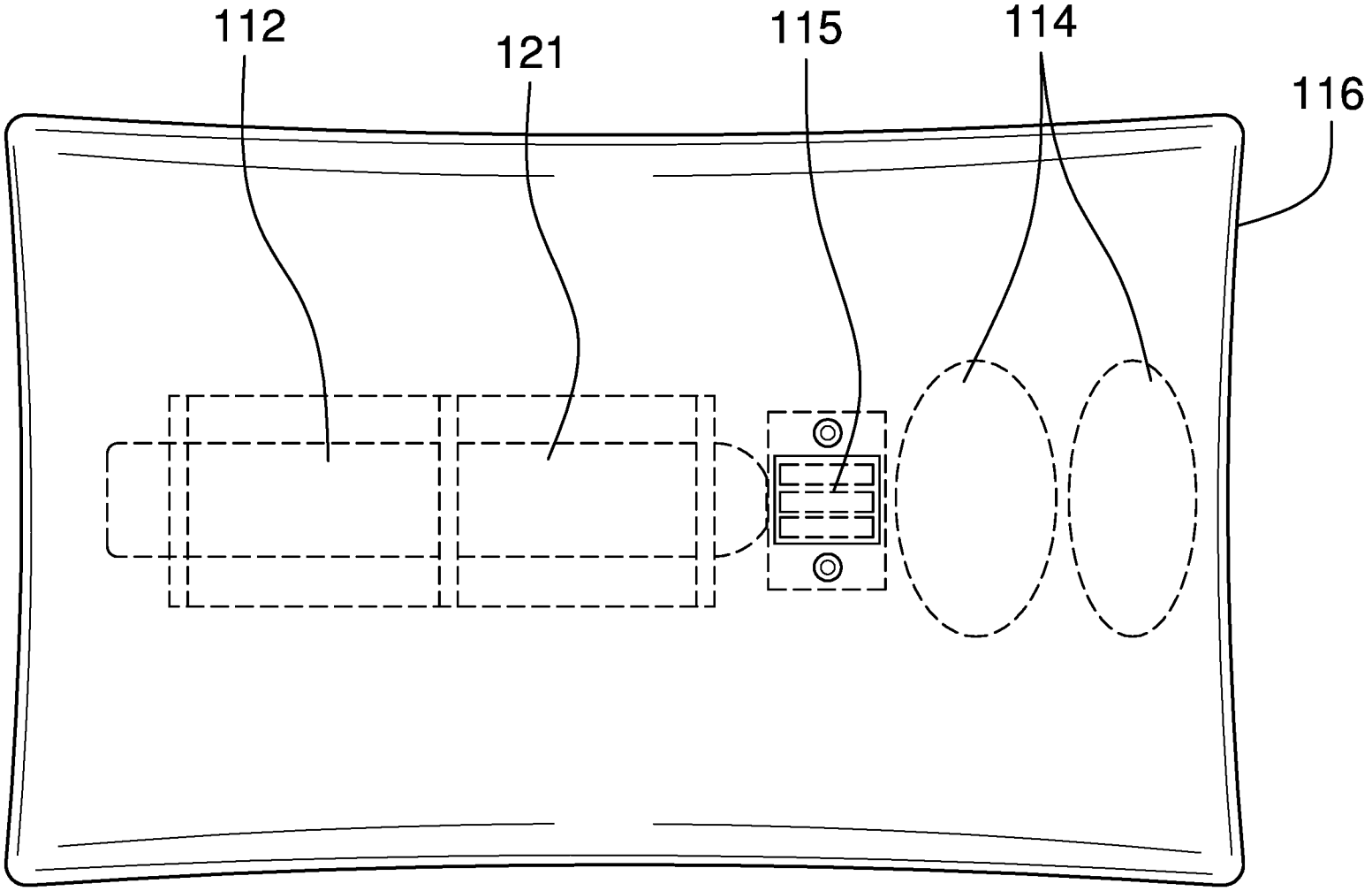
FIG. 3 is a bottom view of an embodiment of the disclosure.
Figure 4:
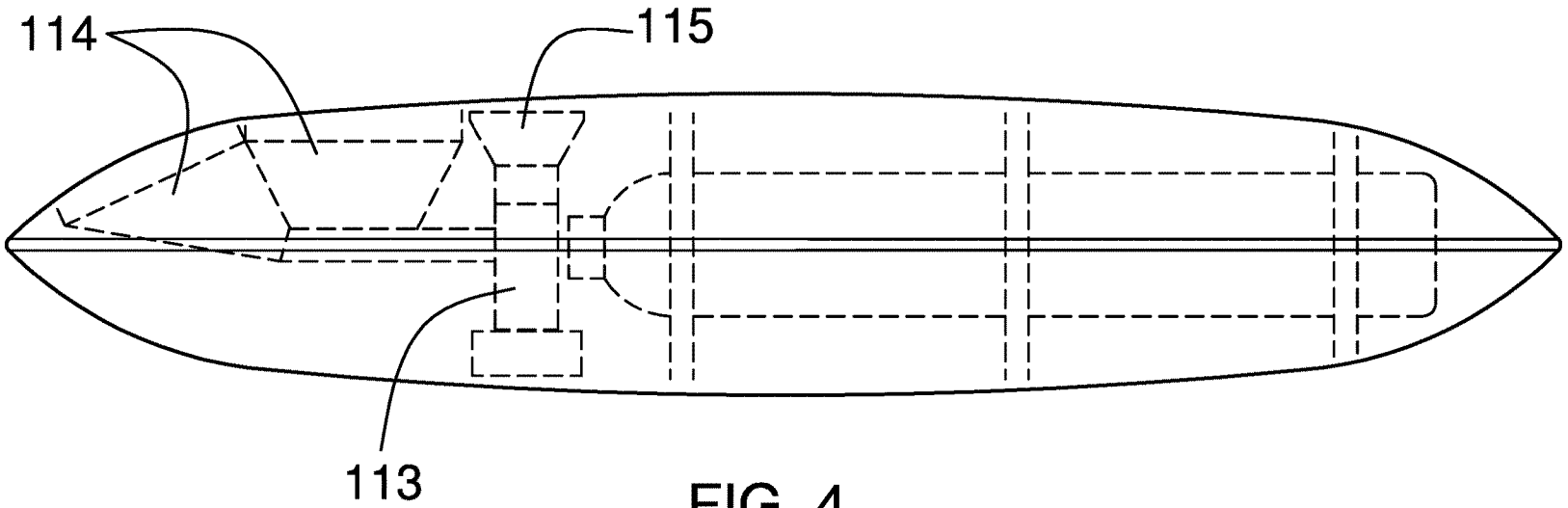
FIG. 4 is a side view of an embodiment of the disclosure.
Figure 5:
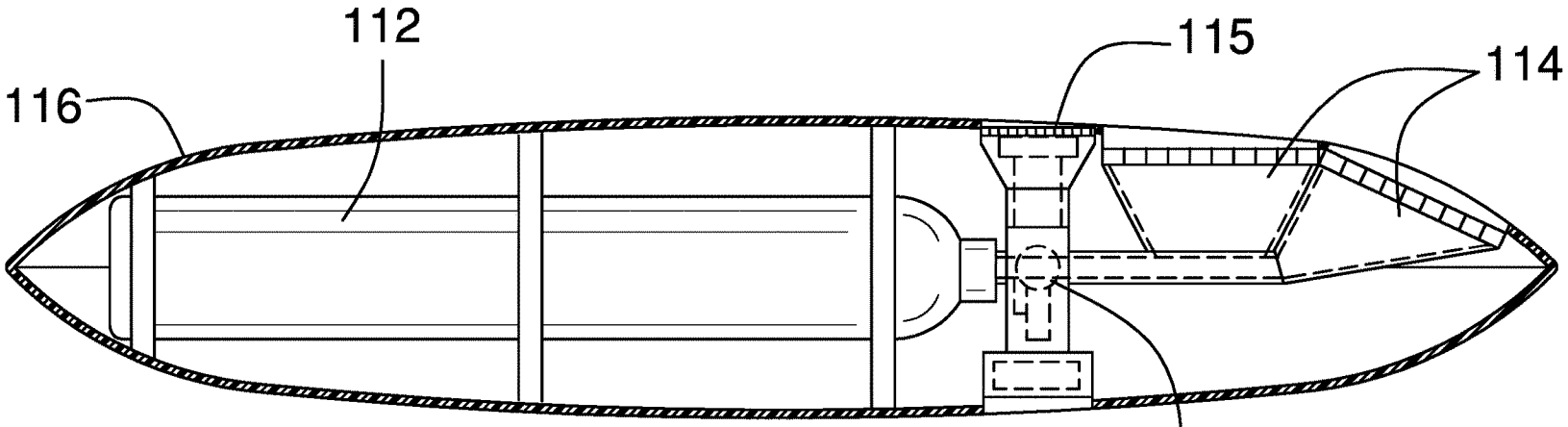
FIG. 5 is a cross-sectional view of an embodiment of the disclosure across 5-5 as shown in FIG. 2.
Figure 6:
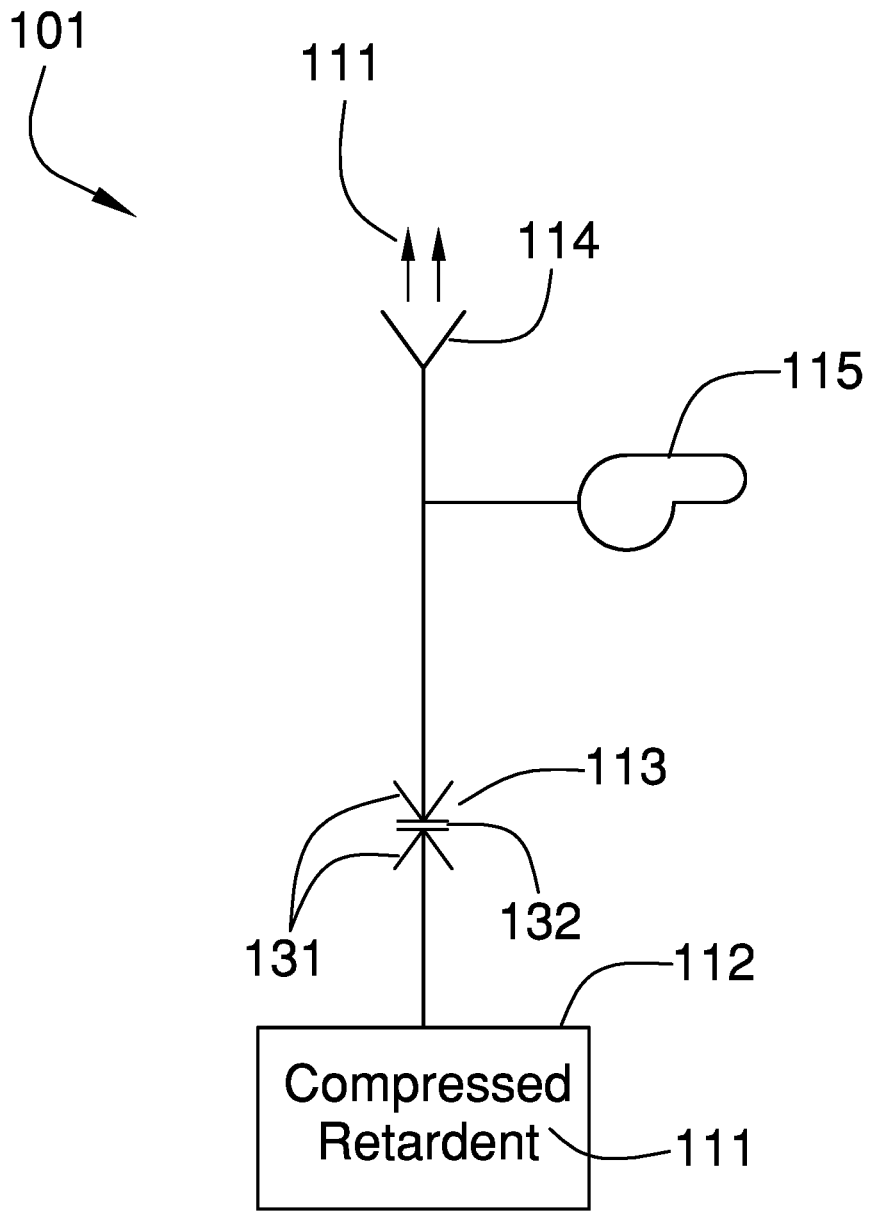
FIG. 6 is a block diagram of an embodiment of the disclosure.
Figure 7:
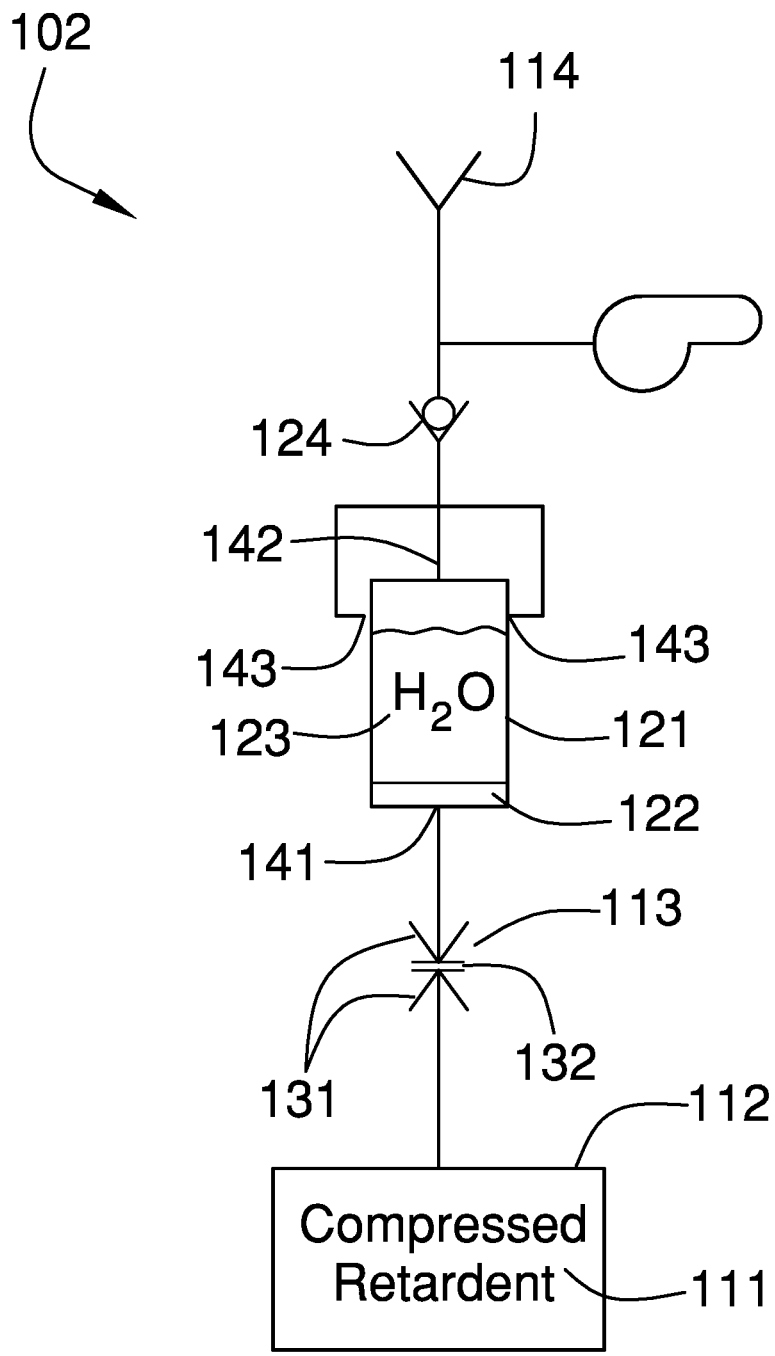
FIG. 7 is a block diagram of an embodiment of the disclosure.

Detailed reference will now be made to one or more potential embodiments of the disclosure, which are illustrated in FIGS. 1 through 7.

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety. Within this disclosure, the non-provisional application U.S. Ser. No. 15/936,722 will also be referred to as the prior disclosure.

The present disclosure will only reference the elements of the non-provisional application U.S. Ser. No. 15/936,722 that are relevant to the innovations disclosed within this application. This is done for purposes of simplicity and clarity of exposition. The applicant notes that this disclosure incorporates non-provisional application U.S. Ser. No. 15/936,722 in its entirety into this application. The fact that any specific innovation selected from the one or more innovations disclosed within U.S. Ser. No. 15/936,722 is not addressed in this application should not be interpreted as an indication of defect in the above-referenced patent.

The automatic fire extinguisher 100 (hereinafter invention) is an automated fire retardant dispensing device. The invention 100 is a self-contained unit. The invention 100 is configured for use in a commercial aircraft. The invention 100 is contained within a pillow 116 that is commonly used for the comfort of passengers within the commercial aircraft. The invention 100 is a temperature sensitive device. The invention 100 dispenses the fire retardant when the temperature of the invention 100 reaches a predetermined temperature. In the primary embodiment 101 of the invention 100, when the predetermined temperature is reached, the invention 100 releases a fire retardant in the form of a compressed gas into the atmosphere. In a secondary embodiment 102 of the disclosure, the invention 100 releases both the fire retardant and water 123 into the atmosphere.

The primary embodiment 101 is formed with one moving part and no mechanical linkages. The secondary embodiment 102 is formed with two moving parts and no mechanical linkages. The primary embodiment 101 comprises a compressed retardant gas 111, a high-pressure gas tank 112, and a release valve 113, one or more nozzles 114, a whistle 115 and a pillow 116. The secondary embodiment 102 comprises the components of the primary embodiment 101 and further comprises a chamber 121, a plug 122, water 123, and a check valve 124.

The invention 100 comprises a primary embodiment 101. The primary embodiment 101 is the primary fire extinguishing mechanism of the invention 100. The primary embodiment 101 releases an inert gas into the atmosphere which deprives a fire of oxygen. The primary embodiment 101 is an automated device. The primary embodiment 101 comprises one moving part. The primary embodiment 101 does not use any mechanical linkages. The primary embodiment 101 comprises a compressed retardant gas 111, a high-pressure gas tank 112, a release valve 113, one or more nozzles 114, a whistle 115, and a pillow 116. The compressed retardant gas 111, the high-pressure gas tank 112, the release valve 113, the one or more nozzles 114, and the whistle 115 are fluidically interconnected. The pillow 116 contains the high-pressure gas tank 112, the release valve 113, and the whistle 115. The high-pressure gas tank 112 contains the compressed retardant gas 111.

The compressed retardant gas 111 is the inert gas that is released from the primary embodiment 101. The compressed retardant gas 111 is stored under pressure in the high-pressure gas tank 112. The compressed retardant gas 111 is a gas that reduces the concentration of oxygen around the fire thereby retarding the combustion process. The compressed retardant gas 111 is non-toxic. The compressed retardant gas 111 is selected to have a molecular weight less than oxygen. The compressed retardant gas 111 is diatomic nitrogen. The choice of diatomic nitrogen allows the compressed retardant gas 111 to concentrate in the upper regions of the aircraft. In an emergency situation, the tendency of the released diatomic nitrogen to remain above the oxygen in the atmosphere allows a person to escape the fire by crawling along the ground without risk of asphyxiation.

The high-pressure gas tank 112 is a commercially available cylindrical tank that is rated to store gas under pressure.

The release valve 113 is a spring loaded valve that controls the flow of the compressed retardant gas 111 out of the high-pressure gas tank 112. The release valve 113 is thermally sensitive. Specifically, the release valve 113 is designed to open automatically when the temperature of the invention 100 reaches the predetermined temperature. The release valve 113 comprises a normally open spring loaded valve 131 and a thermal epoxy detent 132.

The normally open spring loaded valve 131 is a commercially available spring loaded valve. The normally open spring loaded valve 131 is in the open position when the spring is in its relaxed shape. The spring of the normally open spring loaded valve 131 is deformed under a force to close the valve.

The thermal epoxy detent 132 is epoxy adhesive that is used to glue the spring of the normally open spring loaded valve 131 in its deformed position such that the normally open spring loaded valve 131 is fixed in a closed position. The method to adhere the spring of the normally open spring loaded valve 131 into the closed position is similar to the methods used to form the "popup thermometer" commonly found in commercially available poultry products.

The thermal epoxy detent 132 is formed from a thermal epoxy. The thermal epoxy is a form of epoxy that is designed to melt at a predetermined temperature. When the temperature of the invention 100 reaches the predetermined temperature, the thermal epoxy forming the thermal epoxy detent 132 will melt, thereby releasing the spring of the normally open spring loaded valve 131. The melting of the thermal epoxy detent 132 thereby releases the compressed retardant gas 111 from the high-pressure gas tank 112 in an emergency situation.

Each of the one or more nozzles 114 is a commercially available device that releases the compressed retardant gas 111 from the invention 100. The one or more nozzles 114 are mounted through the exterior surface of the pillow 116 such that the compressed retardant gas 111 is discharged into the atmosphere that is exterior to the pillow 116. The design and use of the one or more nozzles 114 is well-known and documented fluidic arts.

The whistle 115 is a commercially available device that converts a gas flow into an audible sound. The whistle 115 generates an audible alarm when the compressed retardant gas 111 is released. The discharge of the whistle 115 is mounted through the exterior surface of the pillow 116.

The pillow 116 is a cushioned structure with a rounded rectangular block shape. The pillow 116 forms the exterior surfaces of the invention 100. The pillow 116 is a padded structure used for resting and in preventing from impacts with the invention 100. The pillow 116 forms the housing that contains an embodiment selected from the group consisting of the primary embodiment 101 and the secondary embodiment 102. The pillow 116 is formed with all apertures and form factors necessary to allow the pillow 116 to accommodate the use and operation of the invention 100.

The release valve 113 is the only moving part used in the primary embodiment 101 of the invention 100.

This paragraph describes the assembly of the primary embodiment 101 of the invention 100. The high-pressure gas tank 112 contains the compressed retardant gas 111. The release valve 113 fluidically connects the high-pressure gas tank 112 to each of the one or more nozzles 114. The release valve 113 fluidically connects the high-pressure gas tank 112 to the whistle 115.

This paragraph describes the operation of the primary embodiment 101 of the invention 100. When the temperature of the invention 100 reaches the predetermined temperature, the thermal epoxy that forms the thermal epoxy detent 132 melts. The melting of the thermal epoxy detent 132 releases the normally open spring loaded valve 131 into the open position. The opening of the release valve 113 releases the compressed retardant gas 111 through the one or more nozzles 114 and the whistle 115. The one or more nozzles 114 directs the released compressed retardant gas 111 out of the pillow 116. As the compressed retardant gas 111 passes through the whistle 115, the whistle 115 generates an audible sound that serves as an alarm that the compressed retardant gas 111 has been released in response to a potentially dangerous situation.

The invention 100 further comprises an extension of the primary embodiment 101 known as the secondary embodiment 102. The secondary embodiment 102 performs the functions of the primary embodiment 101. The secondary embodiment 102 further enhances the firefighting mechanism of the primary embodiment 101 by releasing water 123 before the release of the inert gas. The secondary embodiment 102 initially releases the water 123 through the one or more nozzles 114 to deprive the fire of oxygen. The secondary embodiment 102 subsequently releases the inert gas into the atmosphere to further deprive the fire of oxygen. The secondary embodiment 102 comprises two independent moving parts. The secondary embodiment 102 does not use any mechanical linkages.

The secondary embodiment 102 comprises all the elements of the primary embodiment 101 and further comprises a chamber 121, a plug 122, water 123, and a check valve 124. The chamber 121 contains the plug 122 and the water 123. The check valve 124 forms a fluidic connection with the chamber 121. The secondary embodiment 102 is fluidically connected with the primary embodiment 101.

The chamber 121 is a cylindrical tank that forms a containment structure. The water 123 discharged by the secondary embodiment 102 of the invention 100 is stored in the chamber 121. The chamber 121 is sized to fit within the pillow 116. The chamber 121 further comprises a gas inlet port 141, a water release port 142, and a gas release port 143.

The gas inlet port 141 is a fitting that is formed in the exterior surface of the chamber 121. The compressed retardant gas 111 enters the chamber 121 through the gas inlet port 141.

The water release port 142 is a fitting that is formed in the exterior surface of the chamber 121 that is distal from the gas inlet port 141. The water 123 is forced out of the chamber 121 by the compressed retardant gas 111 and the plug 122 through the water release port 142.

The gas release port 143 is a fitting that is formed in the lateral face of the chamber 121. The span of the distance between the gas release port 143 and the water release port 142 of the chamber 121 is greater than the span of the lateral face of the plug 122 as measured parallel to the center axis of the plug 122. The compressed retardant gas 111 escapes the chamber 121 through the gas release port 143.

The plug 122 is a disk-shaped structure. The plug 122 is placed at the end of the chamber 121 proximal to the gas inlet port 141 before the water 123 is introduced into the chamber 121. The plug 122 fits tightly into the chamber 121 such that a light seal is formed. By light seal is meant: 1) that the plug 122 forms a seal tight enough to prevent water 123 from leaking around the plug 122 into the gas inlet port 141 when the plug 122 is positioned in the chamber 121; but, 2) will not inhibit the elevation of the plug 122 when the compressed retardant gas 111 is released from the high-pressure gas tank 112.

When the compressed retardant gas 111 is released from the high-pressure gas tank 112, the compressed retardant gas 111 increases the elevation of the plug 122 such that the water 123 is pushed out of the invention 100.

The span of the lateral face of the plug 122 is selected such that the plug 122 clears the gas release port 143 once the plug 122 has been pushed to the end of the chamber 121.

The water 123 refers to the water 123 that is stored in the chamber 121. The water 123 is dispensed from the invention 100 to extinguish the combustion of the fire. The check valve 124 is a valve that allows for the passage of a fluid in a single direction.

The check valve 124 is configured to pass the water 123 and the compressed retardant gas 111 from the chamber 121 to the one or more nozzles 114 and the whistle 115. The check valve 124 is used to prevent microorganisms from entering the invention 100 through the one or more nozzles 114 and forming a colony in the water 123. The check valve 124 is described in greater detail elsewhere in this disclosure. In the secondary embodiment 102, the check valve 124 is a Tesla valve. The Tesla valve is selected because it has no moving parts.

The release valve 113 and the plug 122 are the only moving parts used in the secondary embodiment 102 of the invention 100.

The following two paragraphs describe the assembly of the secondary embodiment 102 of the invention 100.

The secondary embodiment 102 is a fluidic structure that is installed in series between the release valve 113 and the one or more nozzles 114. The secondary embodiment 102 is a fluidic structure that is installed in series between the release valve 113 and the whistle 115. The gas inlet port 141 of the chamber 121 fluidically connects the release valve 113 such that the release valve 113 controls the flow of the compressed retardant gas 111 from the high-pressure gas tank 112 into the chamber 121.

The water release port 142 fluidically connects the chamber 121 to the check valve 124. The gas release port 143 fluidically connects the chamber 121 to the check valve 124. The check valve 124 fluidically connects the water release port 142 to the one or more nozzles 114. The check valve 124 fluidically connects the gas release port 143 to the one or more nozzles 114. The check valve 124 fluidically connects the water release port 142 to the whistle 115. The check valve 124 fluidically connects the gas release port 143 to the whistle 115.

The following two paragraphs describe the operation of the secondary embodiment 102 of the invention 100.

When the temperature of the invention 100 reaches the predetermined temperature, the thermal epoxy that forms the thermal epoxy detent 132 melts. The melting of the thermal epoxy detent 132 releases the normally open spring loaded valve 131 into the open position. The opening of the release valve 113 releases the compressed retardant gas 111 through the release valve 113 and the gas inlet port 141 into the chamber 121. The compressed retardant gas 111 builds up a pressure underneath the plug 122 that raises the plug 122 and the water 123 stored above the plug 122. As the water 123 is raised through the chamber 121, the pressure of the compressed retardant gas 111 forces the water 123 through the check valve 124 and out of the pillow 116 through the one or more nozzles 114 thereby dispensing the water 123 on to the fire.

When the plug 122 reaches the distal end of the chamber 121, the released compressed retardant gas 111 gains access to the gas release port 143. The gas release port 143 routes the compressed retardant gas 111 through the check valve 124 to the one or more nozzles 114 and the whistle 115. Once the compressed retardant gas 111 is released from the check valve 124, the compressed retardant gas 111: 1) flushes the final amounts of water 123 from the invention 100, 2) is dispensed onto the fire through the one or more nozzles 114; and, 3) flows through the whistle 115 thereby sounding the audible alarm.

The following definitions were used in this disclosure:

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Automatic: As used in this disclosure, automatic refers to a device, process, or a system that operates without human control, supervision or participation in the operation of the device, process, or system. The verb form of automatic is to automate.

Ball Valve: As used in this disclosure, a ball valve is a type of commercially available check valve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable space that is dedicated to a purpose.

Check Valve: As used in this disclosure, a check valve is a valve that permits the flow of fluid or gas in a single direction. Within selected potential embodiments of this disclosure, the check valve is a commercially available product that is selected from the group consisting of a ball valve and a Tesla valve.

Closed Position: As used in this disclosure, a closed position refers to a movable barrier structure that is in an orientation that prevents passage through a port or an aperture. The closed position is often referred to as an object being "closed."

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Compress: In this disclosure, compress means to force into a smaller space.

Compressed Gas: In this disclosure, compressed gas refers to a gas that has been compressed to a pressure greater than atmospheric pressure.

Cushion: As used in this disclosure, a cushion is a pad or pillow formed from soft material that is used for resting, sleeping, or reclining.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detent: As used in this disclosure, a detent is a device for positioning and holding a first object relative to a second object such that the position of the first object relative to the second object is adjustable.

Disk: As used in this disclosure, a disk is a cylindrically shaped object that is flat in appearance.

Epoxide: As used in this disclosure, an epoxide is a functional group formed by a cyclic ether wherein the first carbon atom of the ether and the second carbon atom of the ether are further joined by a covalent bond.

Epoxy: As used in this disclosure, an epoxy is a polymer-based adhesive that is characterized by the use of an epoxide functional group. Epoxy resin is a synonym for epoxy.

Exterior: As used in this disclosure, the exterior is used as a relational term that implies that an object is not contained within the boundary of a structure or a space.

Fitting: As used in this disclosure, a fitting is a component that is attached to a first object. The fitting is used to form a fluidic connection between the first object and a second object.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connection are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Ground: As used in this disclosure, the ground is a solid supporting surface formed by the Earth. The term level ground means that the supporting surface formed by the ground is roughly perpendicular to the force of gravity. Always use supporting surface.

High-Pressure Gas Tank: As used in this disclosure, a high-pressure gas tank is a container that is used to store compressed air.

Housing: As used in this disclosure, a housing is a rigid casing that encloses and protects one or more devices.

Impulse: As used in this disclosure, an impulse refers to the release of energy over a relatively short period of time.

Inert: As used in this disclosure, inert is an adjective that is applied to an object, system, or chemical reaction. Inert means that the object, system, or chemical reaction is incapable of motion or activity or is otherwise unreactive.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Mechanical Linkage: As used in this disclosure, a mechanical linkage is an interconnected arrangement of a plurality of components that are used to manage the transfer of a movement or a force. A mechanical linkage is often referred to as a linkage.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Nitrogen: As used in this disclosure, nitrogen (CAS 7727-37-9) refers to the element with atomic number 7 in the periodic table. The chemical abbreviation for nitrogen is N2.

Nozzle: As used in this disclosure, a nozzle is a device that receives fluid under pressure and releases the fluid in a controlled manner into an environment.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Phase: As used in this disclosure, phase refers to the state of the form of matter. The common states of matter are solid, liquid, gas, and plasma.

Pillow: As used in this disclosure, a pillow is a rectangular cushion that is used to support the head.

Port: As used in this disclosure, a port is an opening formed in an object that allows fluid to flow through the boundary of the object.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reduction-Oxidation Reaction: As used in this disclosure, a reduction-oxidation reaction (also known as a redox reaction) is a chemical reaction involving the transfer of electrons between the reactants of the reaction.

Relaxed Shape: As used in this disclosure, a structure is considered to be in its relaxed state when no shear, strain, or torsional forces are being applied to the structure.

Rectangular Block: As used in this disclosure, a rectangular block refers to a three-dimensional structure comprising six rectangular surfaces (commonly called faces) formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tesla Valve: As used in this disclosure, a Tesla valve is a type of check valve that requires the use of no moving parts.

Thermal Epoxy: As used in this disclosure, a thermal epoxy is an epoxy that is designed to melt at a specific temperature. A thermal epoxy is often used to hold a component in a fixed position until the component reaches the melting point of the thermal epoxy. Thermal epoxies are commonly used in the manufacture of "popup thermometers" commonly found in poultry products.

Turbulence: As used in this disclosure, turbulence describes the motion or flow of a fluid wherein the velocities and pressures within the fluid flow will vary randomly or in an incalculably complex fashion.

Valve: As used in this disclosure, a valve is a device that is used to control the flow of a fluid (gas or liquid) through a pipe.

Whistle: As used in this disclosure, a whistle is a device that adds turbulence to a gas flow to create an audible sound.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fire extinguisher for a commercial aircraft comprising wherein fire extinguisher for a commercial aircraft comprises a first moving part; wherein fire extinguisher for a commercial aircraft is formed with no mechanical linkages; wherein the fire extinguisher for a commercial aircraft is an automated fire retardant dispensing device; wherein the fire extinguisher for a commercial aircraft is a self-contained unit; wherein the fire extinguisher for a commercial aircraft is configured for use in a commercial aircraft; wherein the fire extinguisher for a commercial aircraft is encapsulated within a pillow; wherein the fire extinguisher for a commercial aircraft is a temperature sensitive device; wherein the fire extinguisher for a commercial aircraft dispenses the fire retardant when the temperature of the fire extinguisher for a commercial aircraft reaches a predetermined temperature; wherein the fire extinguisher for a commercial aircraft releases a fire retardant in the form of a compressed gas; wherein the fire extinguisher for a commercial aircraft comprises a primary embodiment; wherein the primary embodiment comprises a compressed retardant gas, a gas tank, and the release valve, one or more nozzles, a whistle, and the pillow; wherein the compressed retardant gas, the gas tank, the release valve, the one or more nozzles, and the whistle are fluidically interconnected; wherein the pillow contains the gas tank, the release valve, and the whistle; wherein the primary embodiment releases the compressed retardant gas into the atmosphere; wherein the primary embodiment is an automated device; wherein the release valve comprises a normally open spring loaded valve and a thermal epoxy detent; wherein the normally open spring loaded valve is a spring loaded valve; wherein the normally open spring loaded valve is in the open position when the spring is in its relaxed shape; wherein the spring of the normally open spring loaded valve is deformed under a force to close the valve; wherein the thermal epoxy detent is epoxy adhesive that is used to glue the spring of the normally open spring loaded valve in its deformed position such that the normally open spring loaded valve is fixed in a closed position.

2. The fire extinguisher for a commercial aircraft according to claim 1 wherein the pillow is a cushioned structure with a rounded rectangular block shape;

wherein the pillow forms the exterior surfaces of the fire extinguisher for a commercial aircraft;

wherein the pillow is a padded structure;

wherein the pillow forms the housing that contains the primary embodiment.

3. The fire extinguisher for a commercial aircraft according to claim 2 wherein the compressed retardant gas is an inert gas that is released from the primary embodiment;

wherein the gas tank contains the compressed retardant gas;

wherein the compressed retardant gas is stored under pressure in the gas tank.

4. The fire extinguisher for a commercial aircraft according to claim 3 wherein the compressed retardant gas is non-toxic;

wherein the compressed retardant gas is selected to have a molecular weight less than oxygen;

wherein the compressed retardant gas is diatomic nitrogen.

5. The fire extinguisher for a commercial aircraft according to claim 4 wherein the gas tank is a tank that is rated to store gas under pressure;

wherein the release valve is a spring loaded valve that controls the flow of the compressed retardant gas out of the gas tank;

wherein the release valve is thermally sensitive;

wherein the release valve opens automatically when the temperature of the fire extinguisher for a commercial aircraft reaches the predetermined temperature.

6. The fire extinguisher for a commercial aircraft according to claim 5 wherein the thermal epoxy detent is formed from a thermal epoxy;

wherein the thermal epoxy melts at a predetermined temperature;

wherein when the temperature of the fire extinguisher for a commercial aircraft reaches the predetermined temperature, the thermal epoxy forming the thermal epoxy detent will melt, thereby releasing the spring of the normally open spring loaded valve;

wherein the melting of the thermal epoxy detent thereby releases the compressed retardant gas from the gas tank.

7. The fire extinguisher for a commercial aircraft according to claim 6 wherein each of the one or more nozzles is a commercially available device that releases the compressed retardant gas from the fire extinguisher for a commercial aircraft;

wherein the one or more nozzles are mounted through the exterior surface of the pillow such that the compressed retardant gas is discharged into the atmosphere that is exterior to the pillow.

8. The fire extinguisher for a commercial aircraft according to claim 7 wherein the whistle converts a gas flow into an audible sound;

wherein the whistle generates an audible alarm when the compressed retardant gas is released;

wherein the discharge of the whistle is mounted through the exterior surface of the pillow.

9. The fire extinguisher for a commercial aircraft according to claim 8 wherein the release valve is the only moving part used in the primary embodiment of the fire extinguisher for a commercial aircraft.

10. The fire extinguisher for a commercial aircraft according to claim 9 wherein the release valve fluidically connects the gas tank to each of the one or more nozzles;

wherein the release valve fluidically connects the gas tank to the whistle;

wherein the one or more nozzles directs the released compressed retardant gas out of the pillow;

wherein as the compressed retardant gas passes through the whistle, the whistle generates an audible sound.

11. The fire extinguisher for a commercial aircraft according to claim 9 wherein the fire extinguisher for a commercial aircraft further comprises a secondary embodiment;

wherein the secondary embodiment is fluidically connected with the primary embodiment;

wherein the secondary embodiment releases water into the atmosphere before the release of the compressed retardant gas;

wherein the secondary embodiment further comprises a second moving part;

wherein the secondary embodiment is a fluidic structure that is installed in series between the release valve and the one or more nozzles;

wherein the secondary embodiment is a fluidic structure that is installed in series between the release valve and the whistle.

12. The fire extinguisher for a commercial aircraft according to claim 11 wherein the secondary embodiment comprises the components of the primary embodiment and further comprises a chamber, a plug, water, and a check valve;

wherein the chamber contains the plug and the water;

wherein the check valve forms a fluidic connection with the chamber.

13. The fire extinguisher for a commercial aircraft according to claim 12 wherein the chamber is a cylindrical tank that forms a containment structure;

wherein the water discharged by the secondary embodiment of the fire extinguisher for a commercial aircraft is stored in the chamber;

wherein the chamber is sized to fit within the pillow.

14. The fire extinguisher for a commercial aircraft according to claim 13 wherein the chamber further comprises a gas inlet port, a water release port, and a gas release port;

wherein the gas inlet port is a fitting that is formed in the exterior surface of the chamber;

wherein the water release port is a fitting that is formed in the exterior surface of the chamber that is distal from the gas inlet port;

wherein the gas release port is a fitting that is formed in the lateral face of the chamber.

15. The fire extinguisher for a commercial aircraft according to claim 14 wherein the compressed retardant gas enters the chamber through the gas inlet port;

wherein the water is forced out of the chamber by the compressed retardant gas and the plug through the water release port;

wherein the span of the distance between the gas release port and the water release port of the chamber is greater than the span of the lateral face of the plug as measured parallel to the center axis of the plug;

wherein the compressed retardant gas escapes the chamber through the gas release port.

16. The fire extinguisher for a commercial aircraft according to claim 15 wherein the plug is a disk-shaped structure;

wherein the plug is placed at the end of the chamber proximal to the gas inlet port before the water is introduced into the chamber;

wherein the plug fits tightly into the chamber such that a light seal is formed;

wherein by light seal is meant: a) that the plug forms a seal tight enough to prevent water from leaking around the plug into the gas inlet port when the plug is positioned in the chamber; but, b) will not inhibit the elevation of the plug when the compressed retardant gas is released from the gas tank;

wherein when the compressed retardant gas is released from the gas tank, the compressed retardant gas increases the elevation of the plug such that the water is pushed out of the fire extinguisher for a commercial aircraft;

wherein the span of the lateral face of the plug is selected such that the plug clears the gas release port once the plug has been pushed to the end of the chamber.

17. The fire extinguisher for a commercial aircraft according to claim 16 wherein the release valve fluidically connects the gas tank to each of the one or more nozzles;

wherein the release valve fluidically connects the gas tank to the whistle;

wherein the one or more nozzles directs the released compressed retardant gas out of the pillow;

wherein as the compressed retardant gas passes through the whistle, the whistle generates an audible sound.

18. The fire extinguisher for a commercial aircraft according to claim 17 wherein the check valve is a valve that allows for the passage of a fluid in a single direction;

wherein the check valve is configured to pass the water and the compressed retardant gas from the chamber to the one or more nozzles and the whistle;

wherein the gas inlet port of the chamber fluidically connects the release valve such that the release valve controls the flow of the compressed retardant gas from the gas tank into the chamber;

wherein the water release port fluidically connects the chamber to the check valve;

wherein the gas release port fluidically connects the chamber to the check valve;

wherein the check valve fluidically connects the water release port to the one or more nozzles;

wherein the check valve fluidically connects the gas release port to the one or more nozzles;

wherein the check valve fluidically connects the water release port to the whistle;

wherein the check valve fluidically connects the gas release port to the whistle.

* * * * *